United States Patent [19]

Jankevics

[11] Patent Number: 4,955,646

[45] Date of Patent: Sep. 11, 1990

[54] LOCKING DEVICE, ESPECIALLY FOR A COVER OF A SUCTION CLEANER

[75] Inventor: Jan T. Jankevics, Vällingby, Sweden

[73] Assignee: Aktiebolaget Electrolux, Stockholm, Sweden

[21] Appl. No.: 395,905

[22] Filed: Aug. 18, 1989

[30] Foreign Application Priority Data

Sep. 8, 1988 [SE] Sweden ..... 8803164

[51] Int. Cl.[5] ..... E05C 19/06

[52] U.S. Cl. ..... 292/85; 292/86

[58] Field of Search ..... 292/85, 86, 81, 83, 292/19, 91, 80, 87

[56] References Cited

U.S. PATENT DOCUMENTS

| | | | |
|---|---|---|---|
| 195,117 | 9/1877 | Frankel | 292/83 |
| 2,113,687 | 4/1938 | Grace | 292/86 X |
| 2,688,240 | 9/1954 | Treiss, Jr. | 292/85 X |
| 3,540,578 | 11/1970 | Jones | 292/86 X |
| 4,784,361 | 11/1988 | Kobayashi et al. | 292/86 X |
| 4,865,366 | 9/1989 | Kretchman | 292/86 |

FOREIGN PATENT DOCUMENTS

| | | | |
|---|---|---|---|
| 1228966 | 3/1960 | France | 292/85 |

*Primary Examiner*—Lloyd A. Gall

*Attorney, Agent, or Firm*—Pearne, Gordon, McCoy & Granger

[57] ABSTRACT

A locking device, especially for a cover (11) of a suction cleaner, comprises at least one movable latch (12) cooperating with a corresponding step (13) on the cover. The latch is attached to the free end of a leaf spring (14). A control means (17) is provided adjacent the leaf spring and movable in parallel therewith. The control means has a push button (17*a*) at one end and an inclined guide surface (17*b*) at its other end, said guide surface cooperating with a corresponding stationary supporting surface (18). Axial displacement of the control means (17) by means of the push button (17*a*) results in a lateral movement which actuates the leaf spring (14) to release the latch (12) from its engagement with the step (13).

2 Claims, 1 Drawing Sheet

LOCKING DEVICE, ESPECIALLY FOR A COVER OF A SUCTION CLEANER

BACKGROUND OF THE INVENTION

The present invention relates to a locking device, especially for a cover of a suction cleaner, comprising at least one movable latch adapted to releasably engage a corresponding step on the cover.

SUMMARY OF THE INVENTION

The object of the invention is to provide a locking device which is uncomplicated and can be produced at low cost, and which comprises few movable parts which provides for a high functional reliability. This has been obtained by means of a device of the kind mentioned above which according to the invention is characterized in that the latch is provided at the free end of a leaf spring attached to a stationary portion, a control means being provided adjacent to said leaf spring and movable parallel therewith, said control means having a push button at one end and an oblique guide surface at its other end, said guide surface engaging a corresponding stationary supporting surface and when displaced axially due to actuation of said push button providing a lateral movement which actuates said leaf spring to release the engagement of said latch with said step.

BRIEF DESCRIPTION OF THE DRAWING

The invention will be described in more detail below with reference to the accompanying drawing in which.

DETAILED DESCRIPTION OF THE PREFERRED EMBODIMENT

Figure 1:
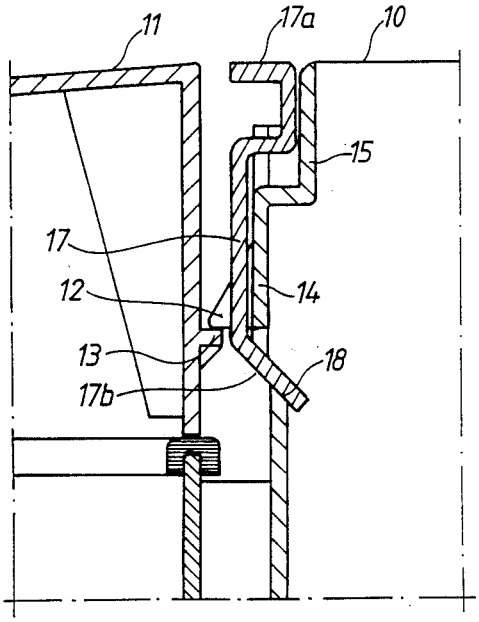
FIG. 1 is a cross-sectional view of the device according to the invention.
Figure 2:
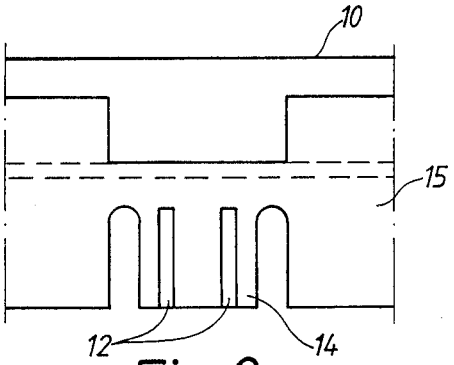
FIG. 2 is a partial side elevation thereof.

On the drawing, a portion of a suction cleaner housing is shown which is generally designated 10 and is provided with an openable cover 11 which is pivotally attached to the housing 10. In FIG. 1, the cover 11 is shown in its closed position and is held in this position by two latches 12 which engage steps 13 provided on the cover. The latches 12 are made integral with a leaf spring 14 which in turn constitutes part of a partition 15 in the suction cleaner housing 10.

A vertically movable control means 17 is provided adjacent the partition 15. The upper end of the control means 17 is made as a push button **17*a* located above the latches 12, and the lower end thereof is inclined at an angle of about 45° to the vertical plane and has an inclined guide surface 17*b* below the latches 12 cooperating with a corresponding inclined supporting surface 18 in the suction cleaner housing. The control means 17 is provided with vertical slots (not shown) through which the latches 12** extend.

When the push button **17*a* is pushed down, the lower portion of the control means 17 is moved to the right in FIG. 1 in that the inclined surface 17*b* slides on the supporting surface 18. The leaf spring 14 is thereby actuated to move in the same direction, whereby the latches 12 are released from the engagement with the step 13. The locking of the cover 11 is thereby released so that it can be opened, i.e. moved upward in FIG. 1. The control means 17 returns to the shown position due to actuation by the spring 14. When the cover 11 is to be closed it is pushed downward whereby the latches 12 are pushed aside by the step 13 against the action of the spring 14 until the locking takes place and the device is again in the position according to FIG. 1**.

I claim:

1. In a locking device for a cover having at least one movable latch (12) adapted to releasably engage a corresponding step (13) on the cover (11), the improvement wherein the latch (12) is provided at a free end of a leaf spring (14) attached to a stationary portion of the locking device, a control means (17) being provided adjacent to said leaf spring and movable parallel to the leaf spring, said control means having a push button (**17*a*) at one end above said latch, and an oblique guide surface (17*b***) at its other end, said guide surface engaging a corresponding inclined stationary supporting surface of the locking device below said latch and, when said control means is displaced axially due to actuation of said push button, providing a lateral movement of the control means which actuates said leaf spring to release the engagement of said latch with said step.

2. A locking device according to claim 1, wherein the guide surface (**17*b*) of the control means (17**) is inclined about 45° to the direction of movement of the control means.

* * * * *